US007382888B2

(12) United States Patent
Aylward et al.

(10) Patent No.: US 7,382,888 B2
(45) Date of Patent: Jun. 3, 2008

(54) PHASE SHIFTING AUDIO SIGNAL COMBINING

(75) Inventors: J. Richard Aylward, Ashland, MA (US); Hilmar Lehnert, Framingham, MA (US); Robert P. Parker, Westborough, MA (US)

(73) Assignee: Bose Corporation, Framingham, MA (US)

( * ) Notice: Subject to any disclaimer, the term of this patent is extended or adjusted under 35 U.S.C. 154(b) by 1763 days.

(21) Appl. No.: 09/735,123

(22) Filed: Dec. 12, 2000

(65) Prior Publication Data

US 2002/0071574 A1 Jun. 13, 2002

(51) Int. Cl.
*H04R 1/40* (2006.01)
*H04R 5/02* (2006.01)

(52) U.S. Cl. ..... 381/97; 381/300; 381/303

(58) Field of Classification Search ..... 381/17, 381/1, 26, 23, 98, 97, 61, 22, 10
See application file for complete search history.

(56) References Cited

U.S. PATENT DOCUMENTS 4,063,034 A * 12/1977 Peters ..... 381/17
4,251,685 A * 2/1981 Fellgett ..... 381/23
4,356,349 A * 10/1982 Robinson ..... 381/1
4,910,779 A * 3/1990 Cooper et al. ..... 381/26
5,333,201 A * 7/1994 Waller, Jr. ..... 381/22
5,671,287 A * 9/1997 Gerzon ..... 381/17
5,970,152 A * 10/1999 Klayman ..... 381/1
6,332,026 B1 * 12/2001 Kuusama et al. ..... 381/17
6,683,962 B1 * 1/2004 Griesinger ..... 381/97

FOREIGN PATENT DOCUMENTS

WO WO 99/33173 * 7/1999

* cited by examiner

*Primary Examiner*—Sinh N Tran
*Assistant Examiner*—Daniel R Sellers
(74) *Attorney, Agent, or Firm*—Fish & Richardson P.C.

(57) ABSTRACT

Combining audio channel signals includes shifting the phase of a first audio signal relative to a second audio signal. In one embodiment, the relative phase shifting is substantially limited to a predetermined frequency range.

23 Claims, 15 Drawing Sheets

PHASE SHIFTING AUDIO SIGNAL COMBINING

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The invention relates to audio signal combining, and more particularly to adjusting the relative phase of combined signals.

For background reference is made to U.S. Pat. Nos. 4,910,779A, 6,332,026B1, 4,251,682A, 5,671,287A, 4,063,034A, 5,970,152A, 4,356,349A and PCI Application No. WO 99/33173.

It is an important object of the invention to provide an improved method and apparatus for combining audio signals, especially in the bass frequencies.

BRIEF SUMMARY OF THE INVENTION

According to the invention, a method for combining a first audio signal from a first audio channel and a second audio signal from a second audio channel, the first and second audio signals having a first and second frequency range, includes shifting the phase of the first audio signal relative to the second audio signal, wherein the shifting is substantially limited to a first frequency range; and combining the audio signals from the first channel with the audio signal from the second channel.

In another aspect of the invention, an audio system includes an audio signal source having a first channel signal and a second channel signal; first and second electroacoustical transducers for converting the first channel and the second channel, respectively, into sound waves; and a phase shifter, coupled to the audio signal source for shifting, the phase of the first channel signal relative to the second channel signal, substantially limiting the phase shifting to a first range of frequencies.

In another aspect of the invention, an audio system, includes a first audio channel input for providing a first audio signal; a second audio channel input for providing a second audio signal; phase sifting circuitry, coupled to the first audio channel input and the second audio channel input, for shifting the phase of the first audio signal relative to the second audio signal over a first range of frequencies to produce a partially phase shifted audio signal; and a combiner, for combining the partially phase shifted first audio signal and the second audio signal to produce a combined audio signal.

In still another aspect of the invention, a method for combining n audio signals from n audio signal channels, where n is a number greater than two, includes a relative shifting of the phase of each of the audio signals relative to each of the other audio signals; and combining the n audio signals.

Other features, objects, and advantages will become apparent from the following detailed description, which refers to the following drawing in which:

BRIEF DESCRIPTION OF THE SEVERAL VIEWS OF THE DRAWING

Like reference symbols in the various drawings indicate like elements.

DETAILED DESCRIPTION OF THE INVENTION

Figure 1:
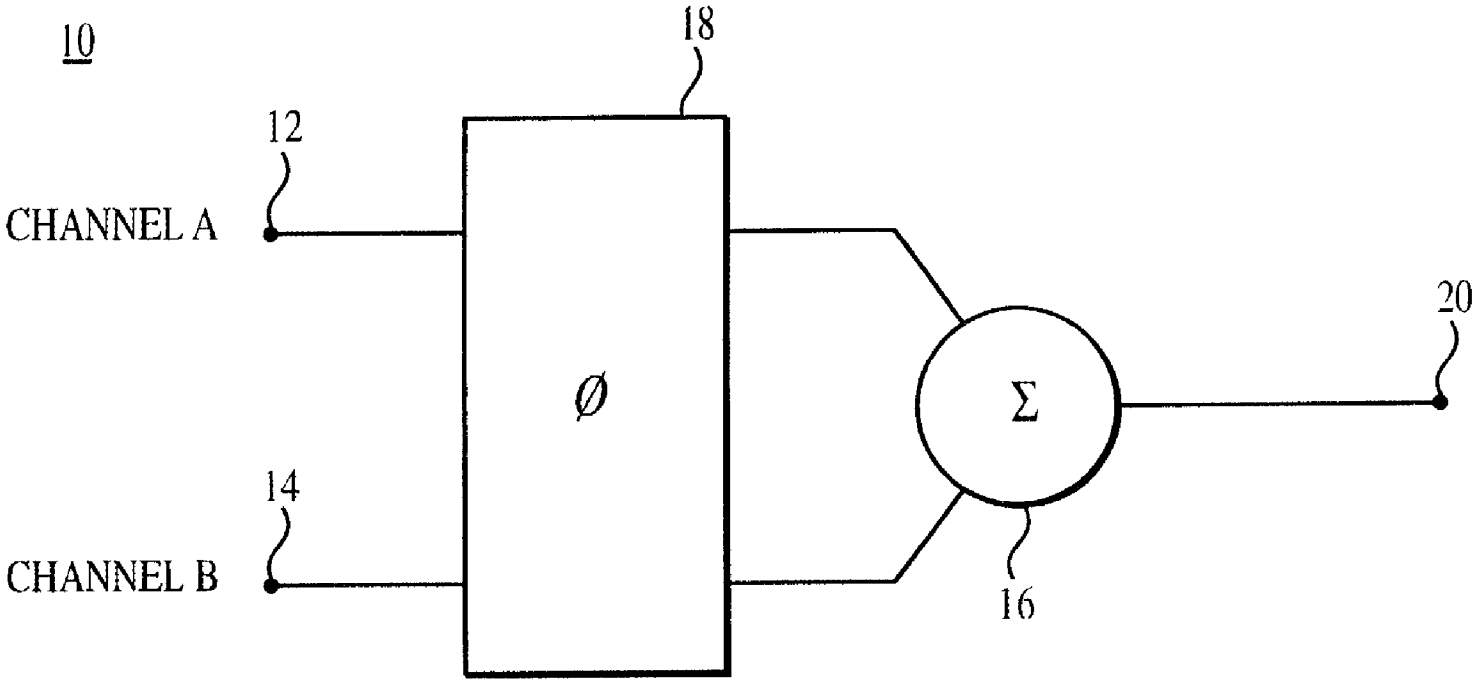
FIG. 1 is a block diagram of a combining circuit according to the invention.

With reference now to the drawings and more particularly to FIG. 1, there is shown a block diagram of a combining circuit according to the invention. Audio system combining circuit 10 has at least two inputs, a first input 12 for receiving audio signals from a first channel, referred to as channel A, and a second input 14 for receiving audio signals from a second channel, referred to as channel B. Second input 14 is coupled to summer 16, and first input 12 is coupled to summer 16 by phase shifting circuitry 18. Summer 16 is coupled to output terminal 20, which provides an output signal representing the combining of the signals received from channel A and the signals received from channel B after phase shifting. Phase shifting circuitry 18 shifts the relative phase of the signal at input 12 relative to the signal at input 14.

Figure 2A:
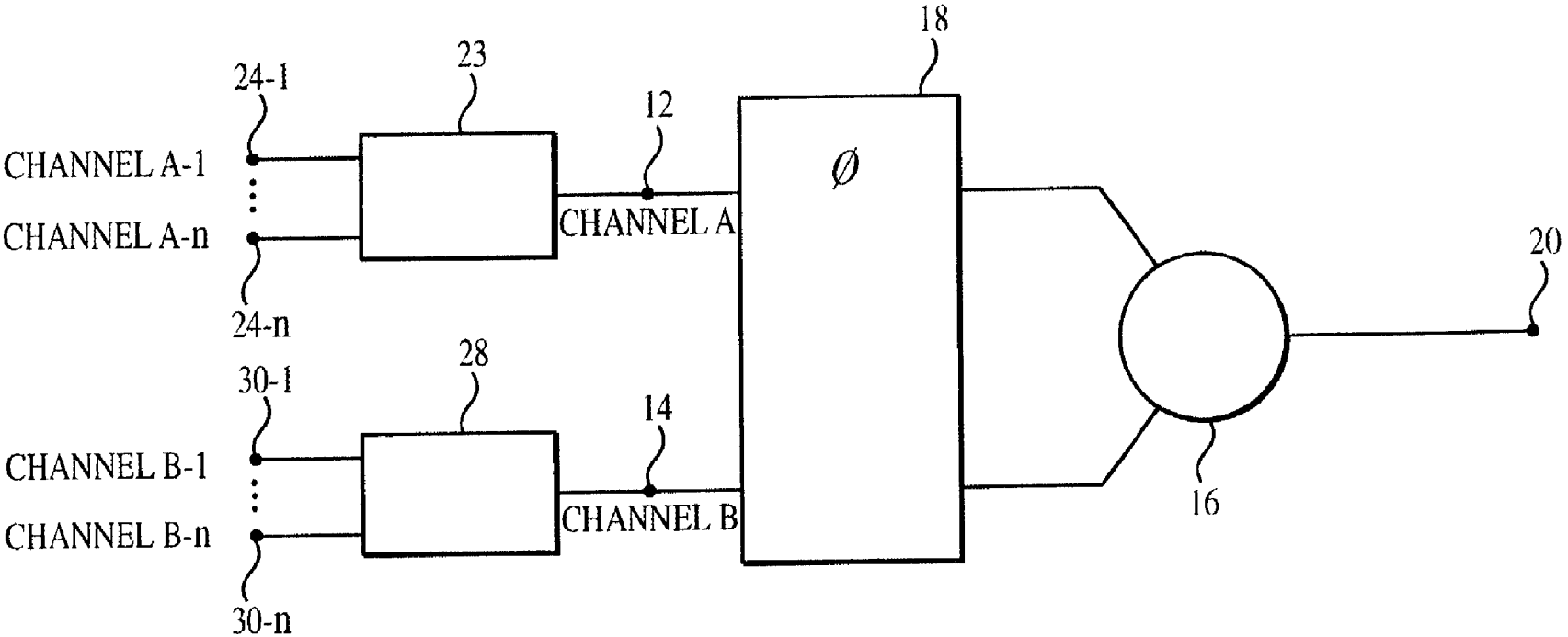
FIGS. 2*a* and 2*b* are alternate embodiments of the invention.

Referring to FIG. 2*a*, there is shown another embodiment of the invention. The embodiment of FIG. 2 has the elements of FIG. 1, and additional elements. Downmixing combiner 23 has a plurality of input terminals 24-1 . . . 24-n and has an output that is coupled to input 12. Combining circuit 28 has a plurality of input terminals 30-1 . . . 30-n and has an output coupled to input 14. Combining circuit 23 receives channels A-1 . . . A-n at inputs 24-1 . . . 24-n respectively, and combines channels A-1 . . . A-n to form channel A. Combining circuit 28 receives channels B-1 . . . B-n at inputs 30-1 . . . 30-n respectively, and combines channels B-1 . . . B-n n to form channel B. This embodiment illustrates the principle that the channels combined by the invention may be channels that have been formed by combining ("downmixing") other channels. Combining circuitry 23 and 28 can be one of a number of different downmixing circuits. Combining circuitry 23 and 28 may have a plurality of cascaded stages for combining the signals input at the input terminals.

Figure 2B:
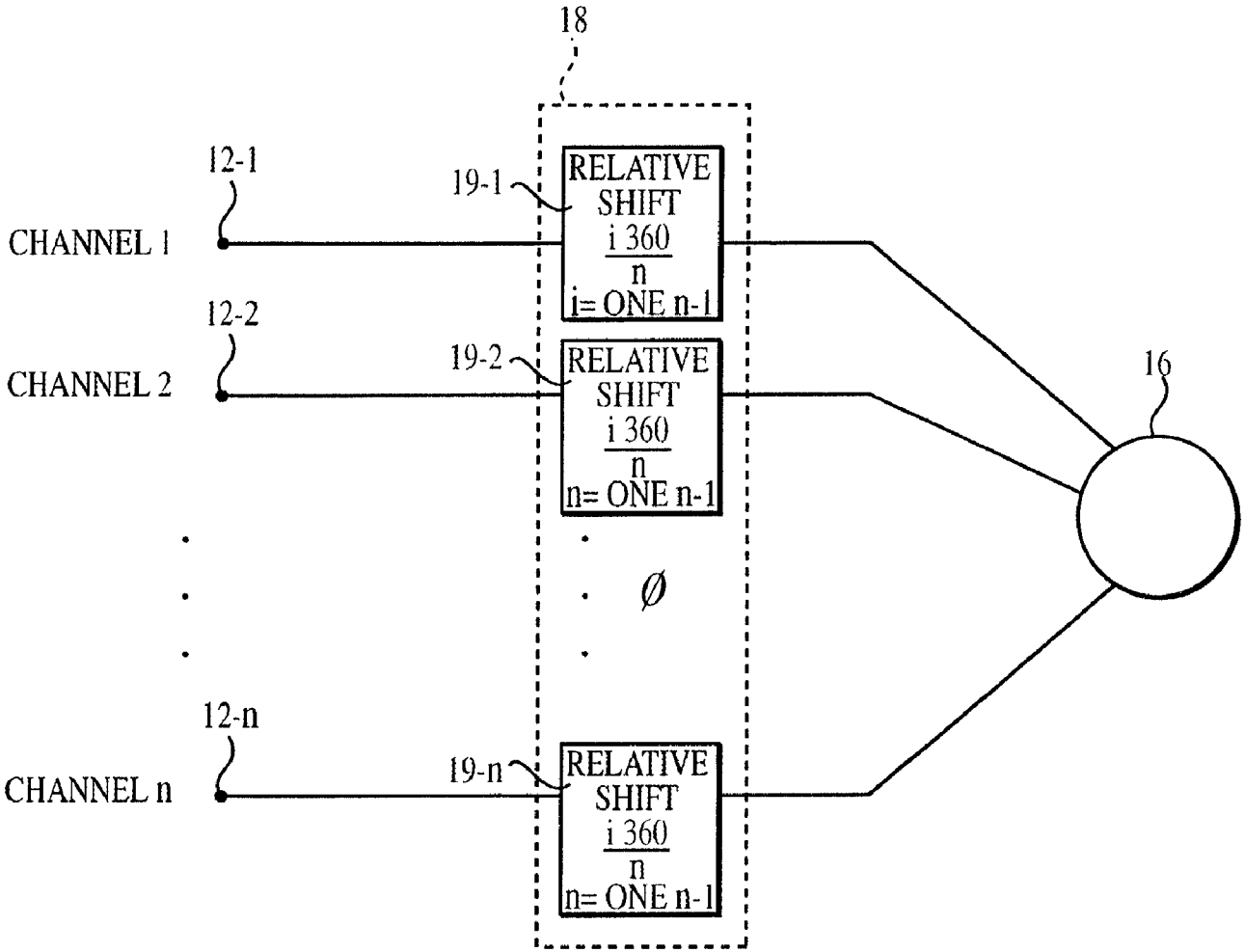

Referring to FIG. 2*b*, there is shown another embodiment of the invention, for combining three or more signals, which may represent three or more channels. The signals are input at input terminals 12-1 . . . 12-n. Phase shifting circuitry 18 shifts the phase of each signal, so that the relative phase of the signal input at an input terminal is shifted relative to that of the other signals. The relative phase shifts can be non-uniform or uniform according to a pattern, for example, by shifting each channel by i360/n degrees (where i=0 to n−1, or i=1 to n). Care should be taken so that if a relative shift of greater than 120 degrees and less than 240 degrees occurs between two channels, it should occur only between channels that are unlikely to have correlated and in-phase content. Typically, diagonal channel pairs (left surround/right front, and right surround/left front) are unlikely to have correlated and in-phase content. One way of implementing the phase shifting circuitry of FIG. 2*b* is to apply individual phase shifting elements 19-1 . . . 19-n, such as all-pass filters as will be discussed below.

Figure 3A:
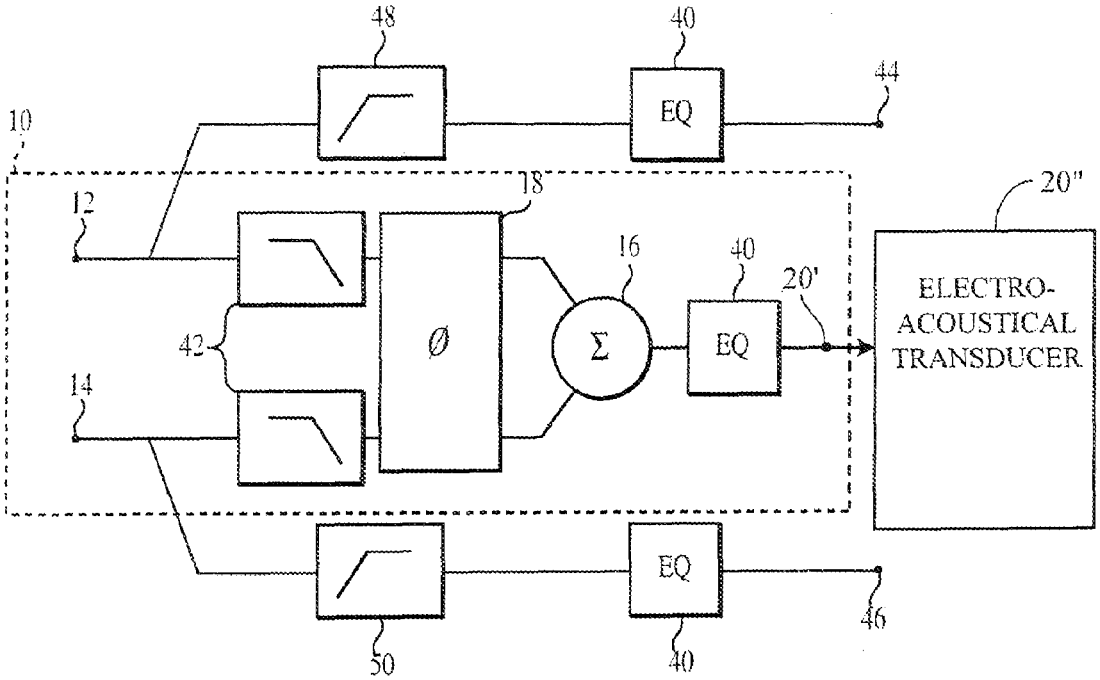
FIGS. 3*a*-3*d* are block diagrams of circuits implementing the combining circuit of FIG. 1 and showing an additional feature of the invention.
Figure 3B:
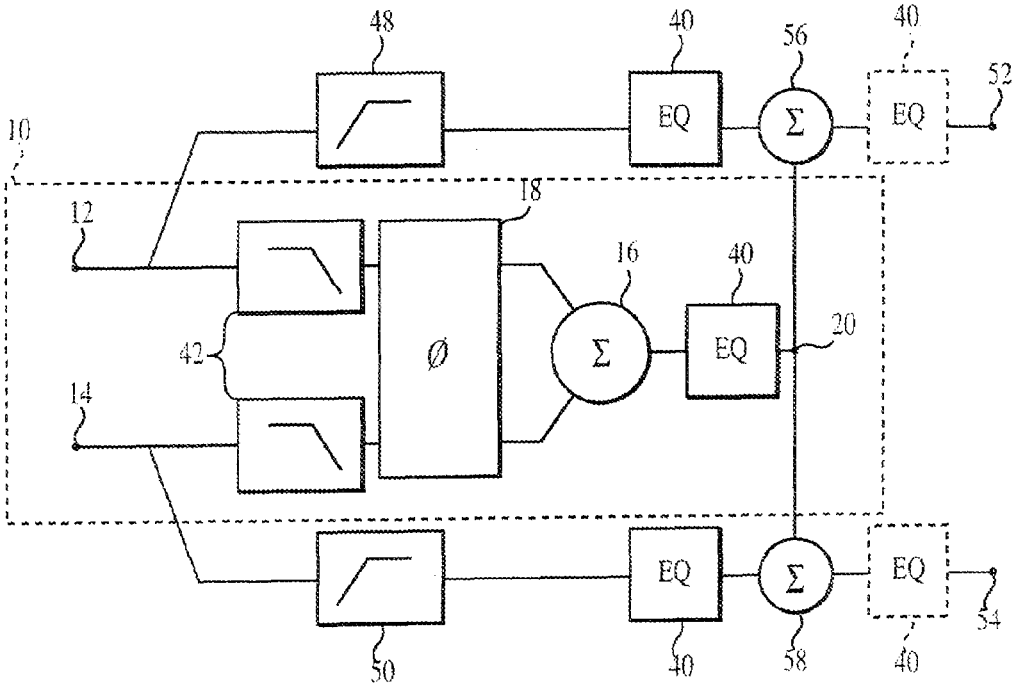
Figure 3C:
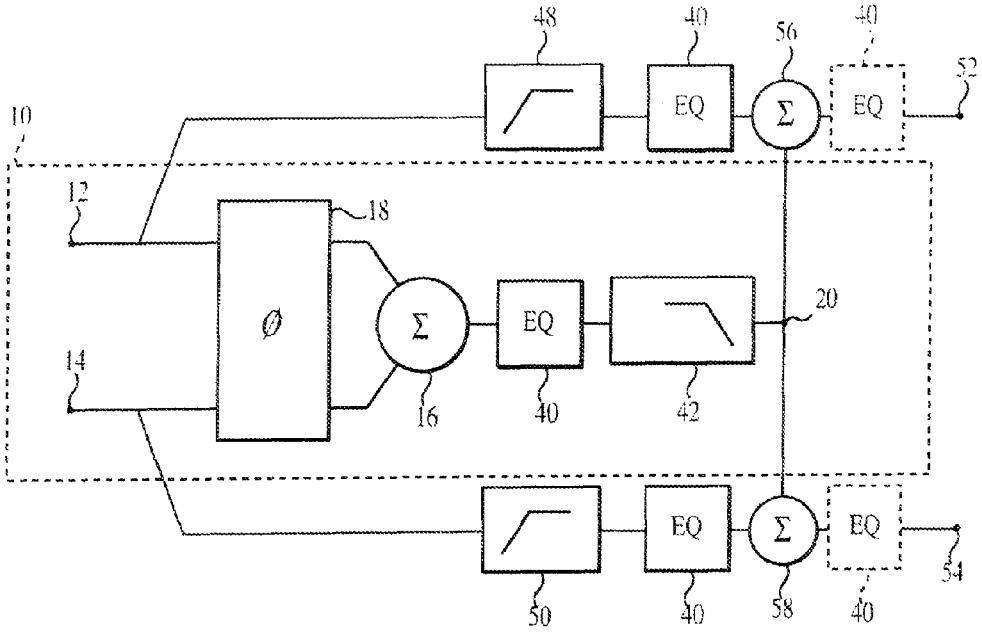
Figure 3D:
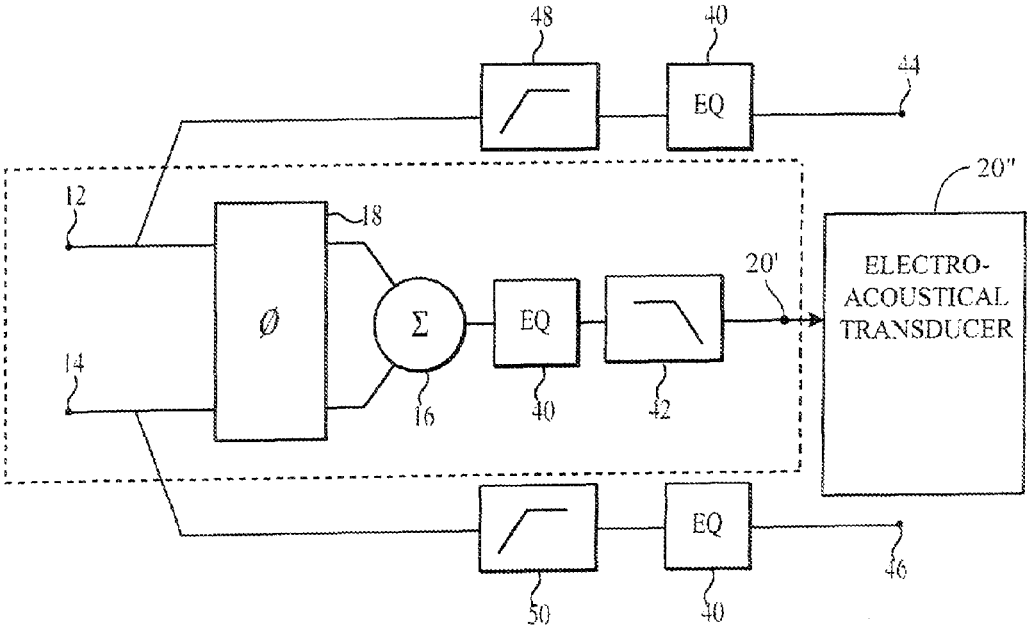

Referring now to FIGS. 3*a*-3*d*, there are shown four block diagrams of four audio signal processing circuits implementing the combining circuit of FIG. 1 and showing an additional feature of the invention. In the implementations of FIGS. 3*a* and 3*c*, combining circuit 10 has additionally one or more low-pass filters 42 and may have equalizers 40 coupling the output terminals 20', 44, 46, 52, 54 with the other portions of the circuitry. Two low-pass filters 42 may be placed so that they couple input terminals 12 and 14 with phase shifting circuitry 18, respectively (as shown in FIGS. 3*a* and 3*b*), or one low pass filter may be placed so that it couples output of summer 16 with output terminal 20 (as shown in FIGS. 3*c* and 3*d*). Low-pass filters 42 operate so that the audio signals at output terminal 20 contain only spectral components in the bass frequency range. The placement and purpose of the equalizer 40 will be discussed below. In the implementations of FIGS. 3*a* and 3*d*, the combining circuit 10 is implemented in an audio system having two high frequency channel output terminals 44 and 46 and a bass output terminal 20'. The high frequency output terminals 44 and 46 are coupled to input terminals 12 and 14 by high pass filters 48 and 50. The implementations of FIGS. 3*a* and 3*d* are typical of a satellite system, in which the low frequency sounds from all channels are electro acoustically transduced by and radiated from a nonlocalizable module 20' that is an electroacoustical transducer, and in which the high frequency sounds are radiated from a plurality of upper frequency radiators.

In the implementations of FIGS. 3*b* and 3*c*, the combining circuit 10 is implemented in an audio system having two output terminals 52 and 54 to which full range speakers are coupled. In FIGS. 3*b* and 3*c*, the inputs of summers 56 and 58 are coupled to input terminals 12 and 14 by high-pass filters 48 and 50, respectively. The inputs of summers 56 and 58 are also coupled to output terminal 20, and the output of summers 56 and 58 are coupled to full range output terminals 52 and 54. The result is that audio signals at terminals 52 and 54 include the bass spectral components, phase shifted and combined, and the high frequency portions of the channels input at input terminals 12 and 14. The implementations of FIGS. 3*b* and 3*c* are typical of audio systems employing a plurality of fill range speakers.

To improve frequency response, equalizers 40 may be employed to adjust the frequency response. In the implementations of FIGS. 3*a* and 3*d*, there may be equalizers 40 coupling input terminals 12 and 14 with output terminals 44 and 46 respectively, and an equalizer 40 coupling summer 16 and bass output terminal 20'. In the implementations of FIGS. 3*b* and 3*c*, there may be equalizers 40 coupling input terminals 12 and 14 with summers 56 and 58 respectively, and an equalizer 40 coupling summer 16 and combining circuit output terminal 20. Alternatively, in the implementations of FIGS. 3*b* and 3*c*, the three equalizers may be replaced by two equalizers coupling summers 56 and 58 with output terminals 52 and 54, respectively.

In the systems of FIGS. 3*a*-3*d*, the signal summing or combining at summers 16 may be additive or differential. Additive and differential summation may give different results, especially if the signals contain "surround" information encoded using some popular techniques. Generally, differential summation works well in all circumstances, while additive summation may work less well.

Figure 4A:
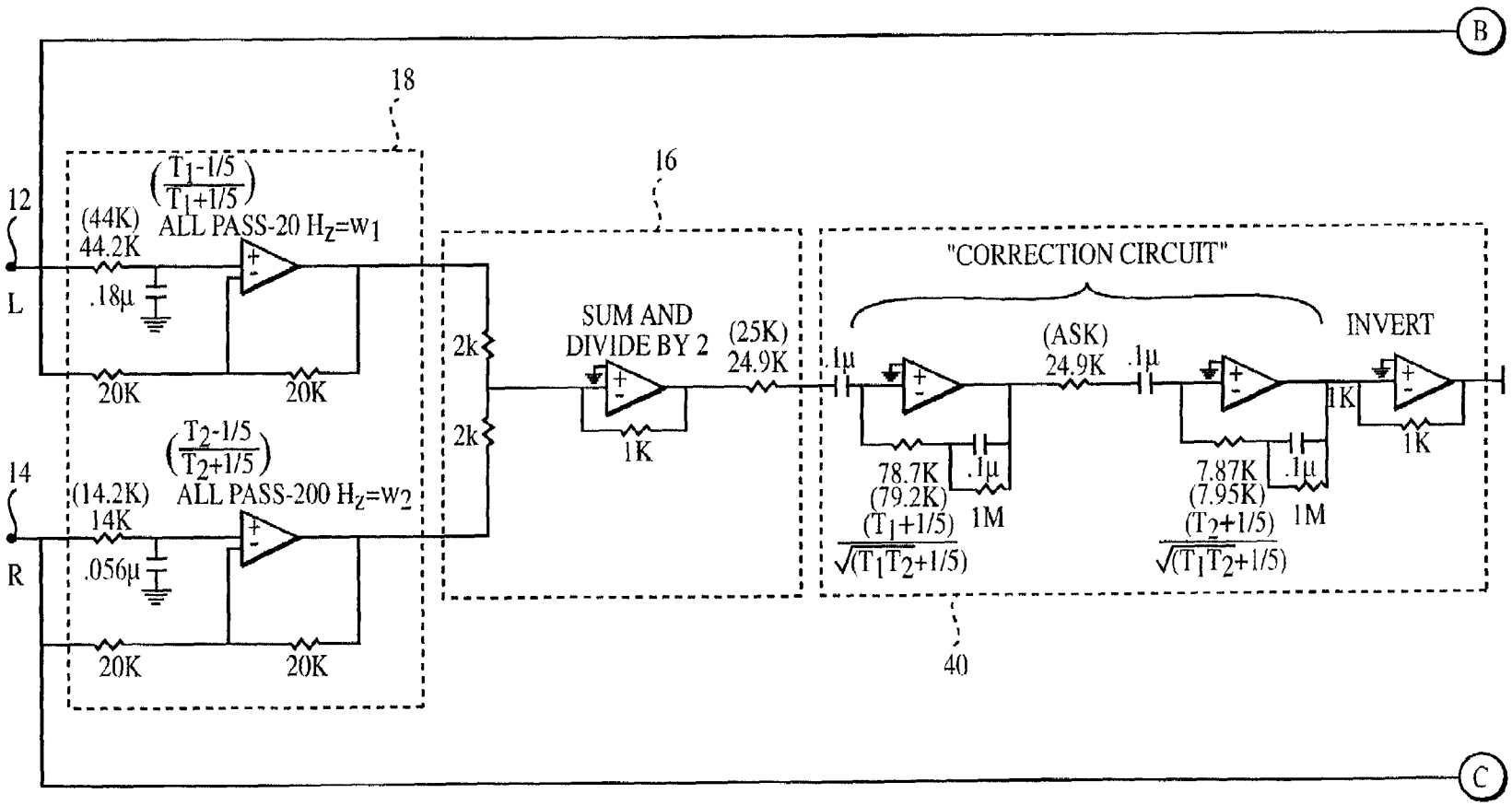
FIGS. 4*a* and 4*b* are schematic diagrams of a test circuit for illustrating some features of the invention.
Figure 4B:
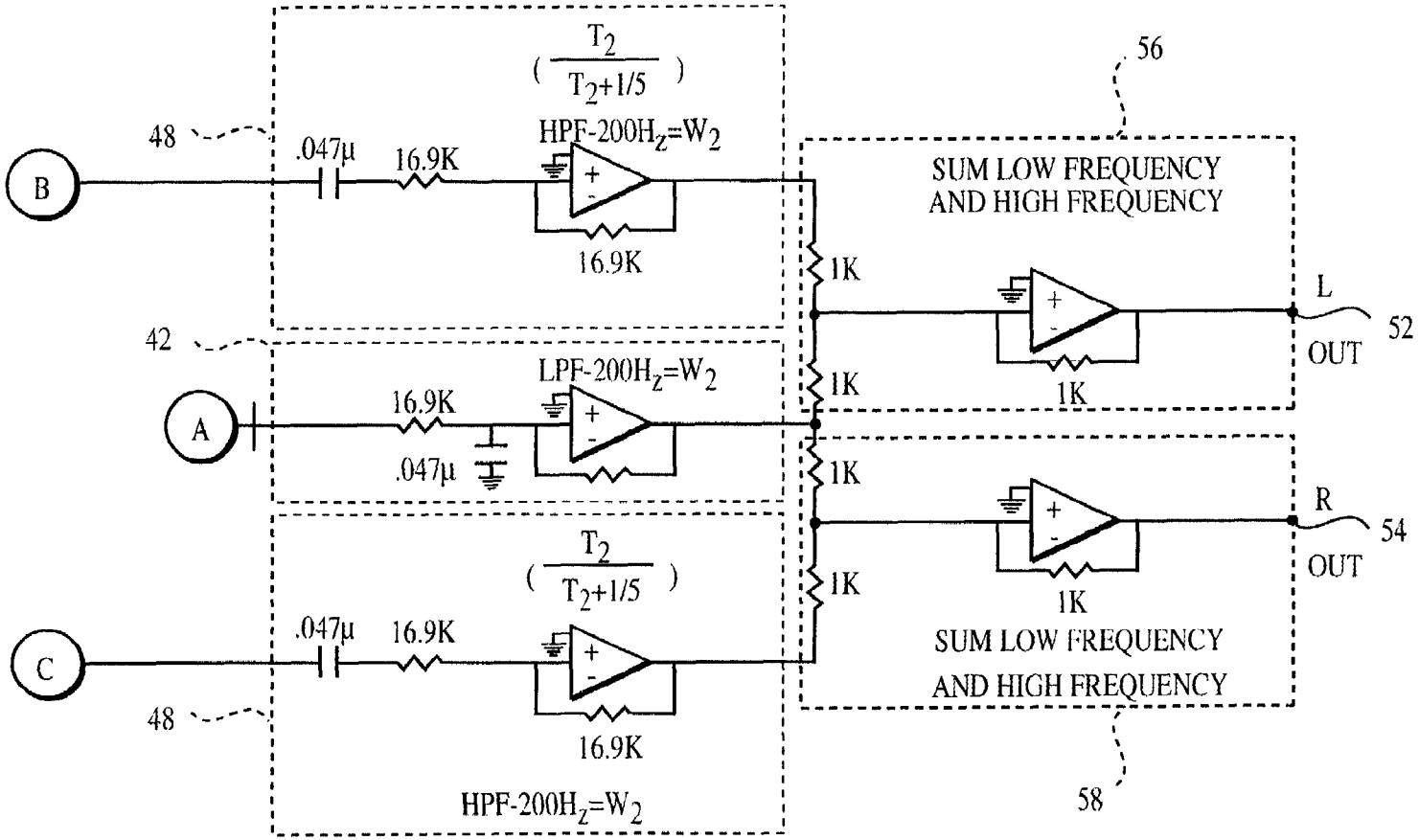

Referring now to FIGS. 4*a* and 4*b*, there is shown a schematic diagram of the signal processing portion of a test circuit for illustrating some of the features of the invention. The circuit of FIGS. 4*a* and 4*b* implements a system having the topology of FIG. 3*c*, with a single equalizer 40 coupling summer 16 and low pass filter 42. In FIGS. 4*a* and 4*b*, the reference numerals refer to portions of the circuit which implement the blocks of FIG. 3*c*.

Figure 5A:
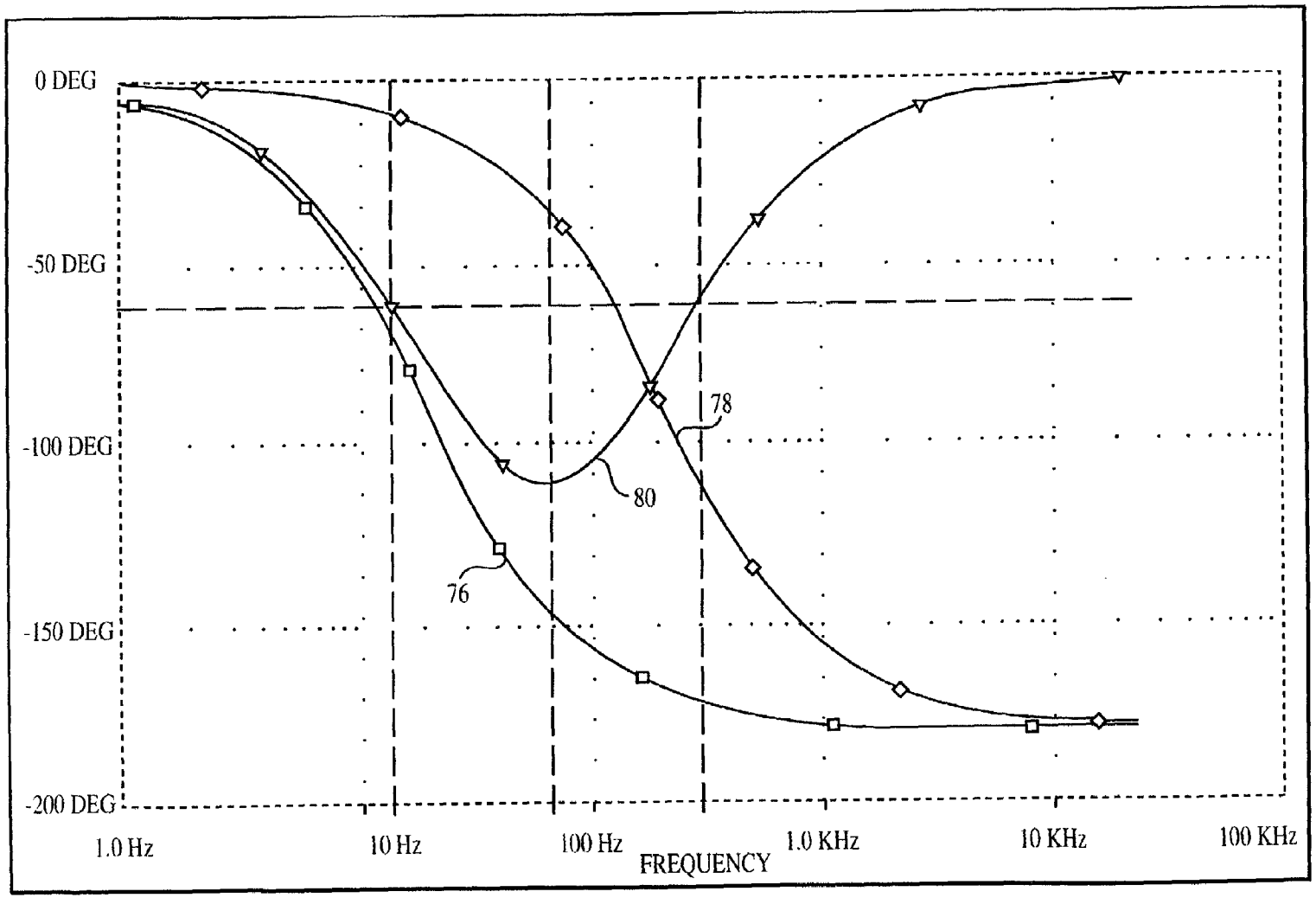
FIGS. 5*a* and 5*b* are, respectively, a plot of phase shift versus frequency and a plot of magnitude versus frequency for the circuit of FIGS. 4*a* and 4*b;*

Referring now to FIG. 5*a*, there is shown a plot of phase shift versus frequency for the circuit of FIGS. 4*a* and 4*b*. Curve 76 represents the amount by which the audio signal input at input terminal 12 is shifted by phase shifting circuitry 18. Curve 78 represents the amount by which the audio signal input at input terminal 14 is shifted by phase shifting circuitry 18. Curve 80 represents the phase shift difference between curves 76 and 78, or in other words the relative phase shift imparted by the circuit of FIGS. 4*a* and 4*b*.

In a two-channel system, or in a system in which channels have been downmixed as in the embodiment of FIG. 2*a*, the phase shift difference is preferably 60 to 120 degrees over the frequency range of interest. A phase shift difference of 120 degrees or greater may cause attenuation if the channels were initially in phase. A phase shift difference of 60 degrees or less may not alleviate the signal cancellation problem if the channels were initially out of phase. Generally it is desirable to have signals in the frequency range of interest to be relatively phase shifted by between 60 and 120 degrees, and to have most in the frequency range relatively shifted by close to 90 degrees.

The plot of FIG. 5*a* illustrates the principle that some implementations of the invention, such as the circuit of FIGS. 4*a* and 4*b* which employ single stage all-pass filters, do not create the same phase shift difference over the entire frequency band of interest. According to this plot, the circuit of FIGS. 4*a* and 4*b* creates a phase shift difference of between 60 and 120 degrees in the frequency range of about 20 Hz to about 500 Hz, with a maximum phase shift of about 110 degrees at about 90 Hz, and causes a phase shift difference of different amounts, down to nearly zero degrees at other frequencies. This property of a circuit shifting the frequency by zero degrees at some frequencies can be used to advantage in some situations, such as the embodiment of FIG. 8*a* below.

A 90-degree phase shift has an especially desirable property, namely producing a similar boost in the output, regardless of the phase and correlation relationship of the input signals. Generally, the most common phase and correlation relationships between two channels are correlated and in phase, correlated and in phase opposition (that is, out of phase by 180 degrees), and uncorrelated (in which case phase is irrelevant). If two equal amplitude correlated and in-phase channels are combined, the combined output is boosted by 6 dB. If two equal amplitude correlated and 180 degrees out-of-phase signals are combined, they cancel. If two equal amplitude signals are uncorrelated, the combined output is boosted by 3 dB.

With regard to the invention, if the phase shift difference applied by the circuitry is 90 degrees, the resultant combined signal consists of two components with a phase difference of 90 degrees, regardless of whether the two input signals were in phase or out of phase before being combined. When two signals with a phase difference of 90 degrees (regardless of whether they are correlated or uncorrelated) are combined, the boost is about 3 dB. The boost of the circuit is therefore a uniform 3 dB, regardless of whether the two input signals were in phase or out of phase before combining.

Figure 5B:
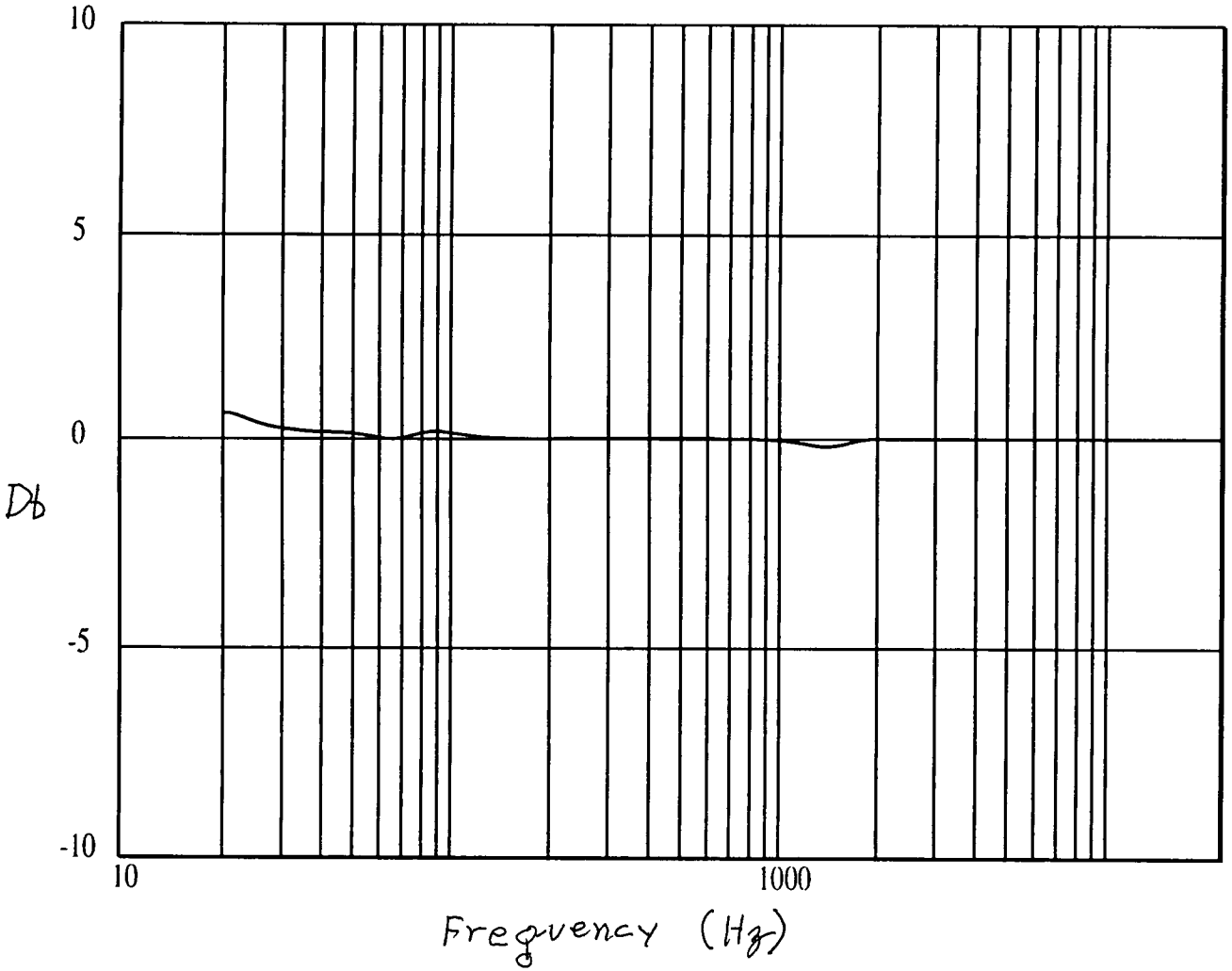

FIG. 5*b* shows that the circuit of FIGS. 4*a* and 4*b* exhibits a substantially consistent 0 dB magnitude response over the frequency range shown.

Figure 6:
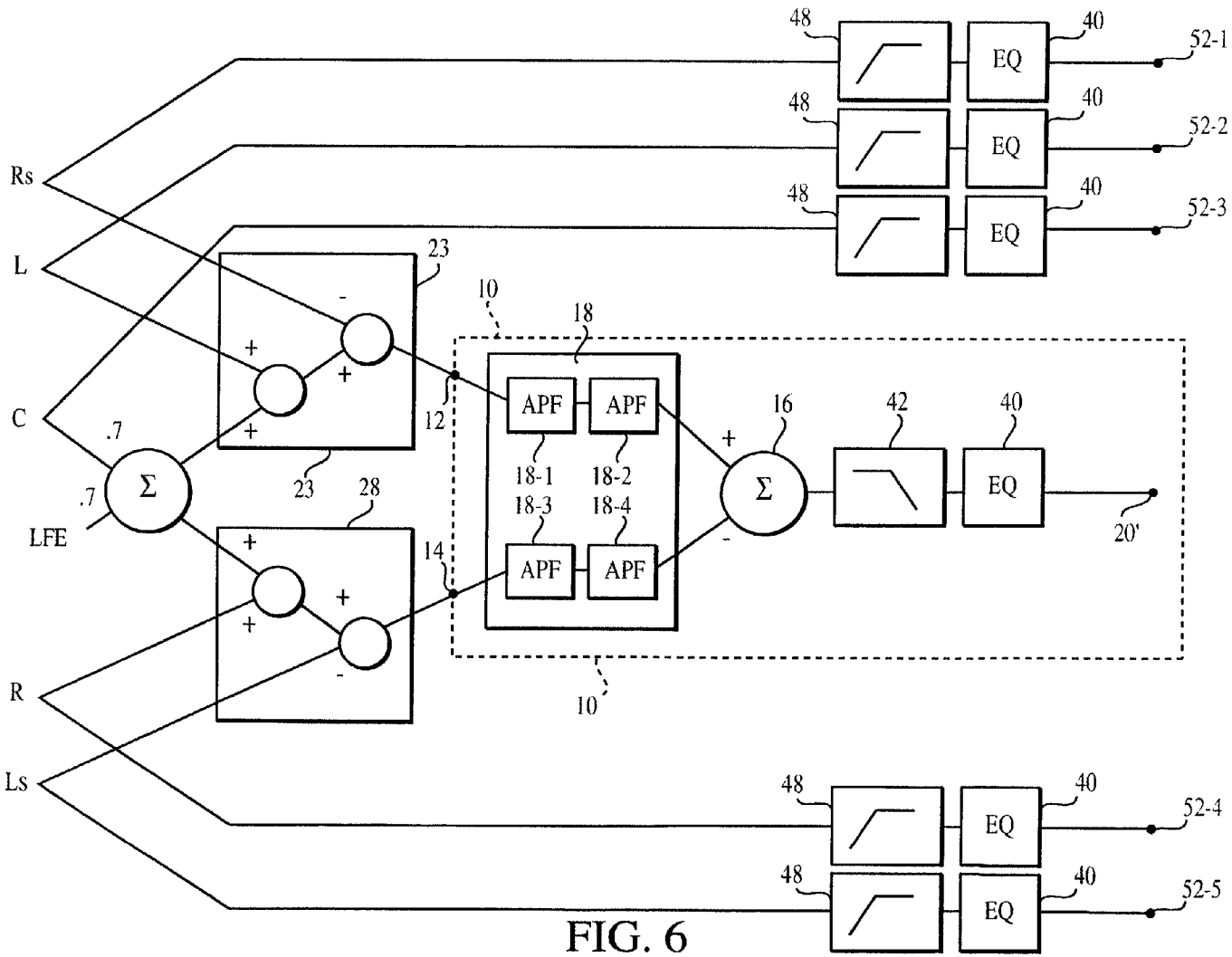
FIG. 6 is a block diagram of an audio signal processing circuit implementing the topology of FIG. 3*a* and illustrating additional features.

Referring now to FIG. 6, there is shown a block diagram of an audio signal processing circuit implementing the topology of FIG. 3*d*, and further including combining circuits for downmixing channels, as shown in FIG. 2*a*. The audio system has six input channels (left surround (Ls), right surround (Rs), low frequency effects (LFE), and center (C). First downmixing combiner 23 has as inputs the Rs channel signal, the L channel signal, and a signal that is the sum of the scaled inputs of the C channel signal and the LFE channel signal. Second downmixing combiner 28 has as inputs the Ls channel signal, the R channel signal, and a signal that is the sum of the scaled inputs of the C channel signal and the LFE channel signal. Phase shifting circuitry 18 includes two cascaded digital all-pass filters 18-1 and 18-2 applied to the signal at input 12 and two cascaded digital all-pass filters 18-3 and 18-4 applied to the signal at input 14. Each of the six input channels has an output channel output terminal, 52-1 through 52-6.

The implementation of FIG. 6 is particularly suited to a digital signal processing 5.1 channel system for decoding matrix encoded signals. With matrix encoded signals, the surround channel signal is shifted in phase with respect to the left and right channel signals by −90 degrees. This signal is then added with the left channel signal and subtracted with the right channel signal such that it appears in the left and right channel signal shifted in phase by a relative 180 degrees. Because of the phase relationships of the channels in a matrix encoded system, the decoded, quadrature shifted, multi-channel signals are differentially combined at summer 16.

Figure 7A:
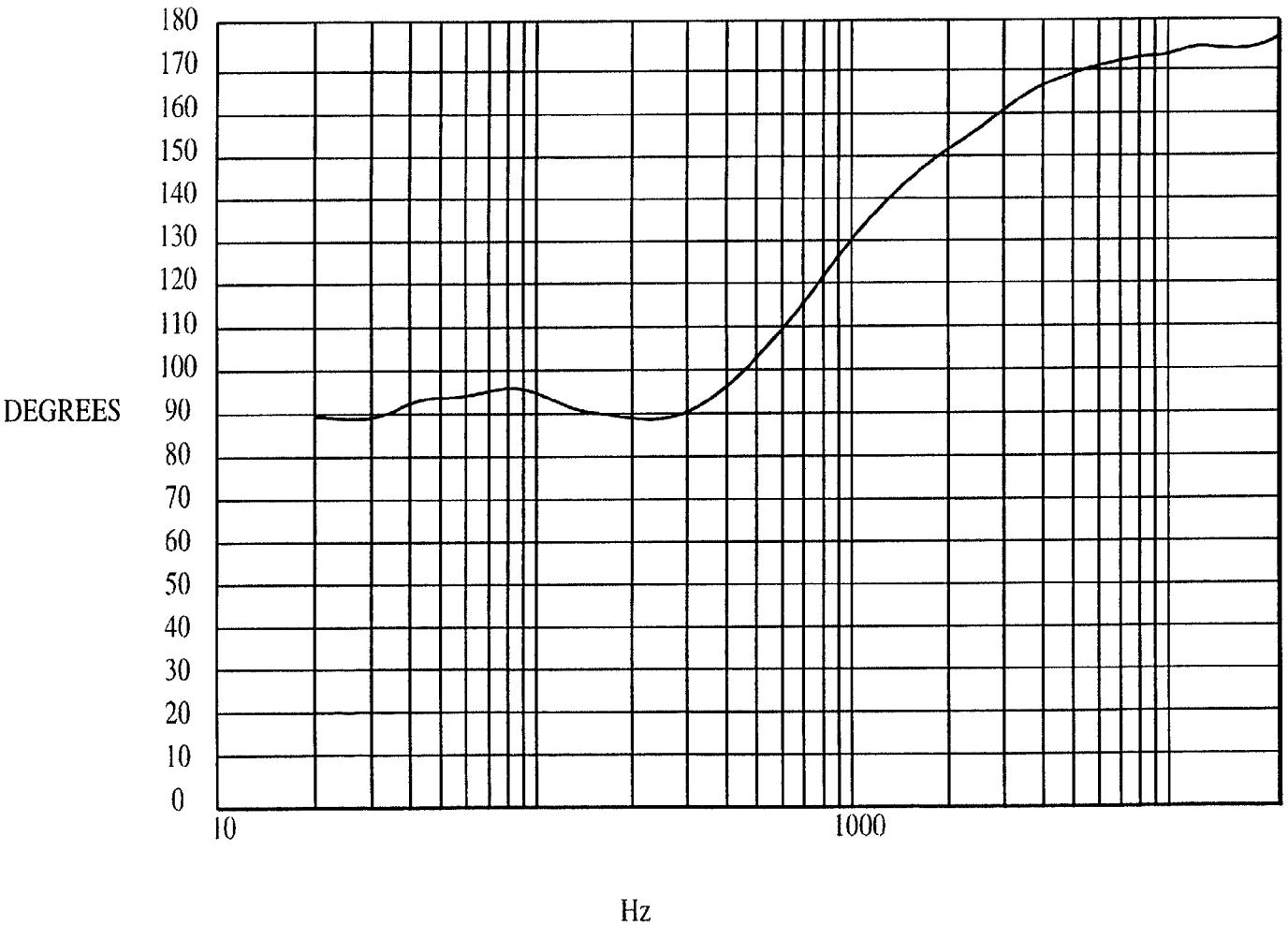
FIGS. 7*a* and 7*b* are, respectively, a plot of phase difference versus frequency and a plot of magnitude versus frequency for the embodiment of FIG. 6.

Referring now to FIG. 7*a*, there is shown a plot of phase shift vs. frequency for the embodiment of FIG. 6, with filter 18-1 having a pole at −8.376 Hz. and a zero at 8.376 Hz, filter 18-2 having a pole at −134 Hz and a zero at 134 Hz, filter 18-3 having a pole at −37.44 Hz and a zero at 37.44 Hz, and filter 18-4 having a pole at −599.17 Hz and a zero at 599.17 Hz. In the implementation of FIG. 6, which has multi-stage all-pass filters, the desirable phase shift of −90 degrees is closely realized over a wide range of frequencies. The frequency spacing in each path (filters 18-1 and 18-2, 8.376 Hz to 134 Hz, filters 18-3 and 18-4, 37.44 Hz to 599.17 Hz) are each a factor of about 16. Generally, an in-path spacing of 16 gives the highest degree of accuracy of in-path phase shift, while an in-path spacing of greater than 16 applies the in-path phase shift over a wider frequency range. The left to right side spacing (8.376 Hz to 37.44 Hz and 134 Hz to 599.17 Hz) are each a factor of 4.5. Generally, a left to right side spacing of 4 gives high accuracy of left to right difference in phase shift, and factors of greater than 4 furnishes the phase shift difference over a wider range of frequencies.

In addition to single stage or multistage all-pass filters, the phase shift circuitry can also be implemented by circuitry implementing Hilbert transform functions. In commercial implementations, all-pass filters may be preferable due to the simplicity of the circuitry. Single and multi-stage all-pass filters and Hilbert transform functions can be implemented using analog circuits, digital circuits, or microprocessors running digital signal processing software.

Figure 7B:
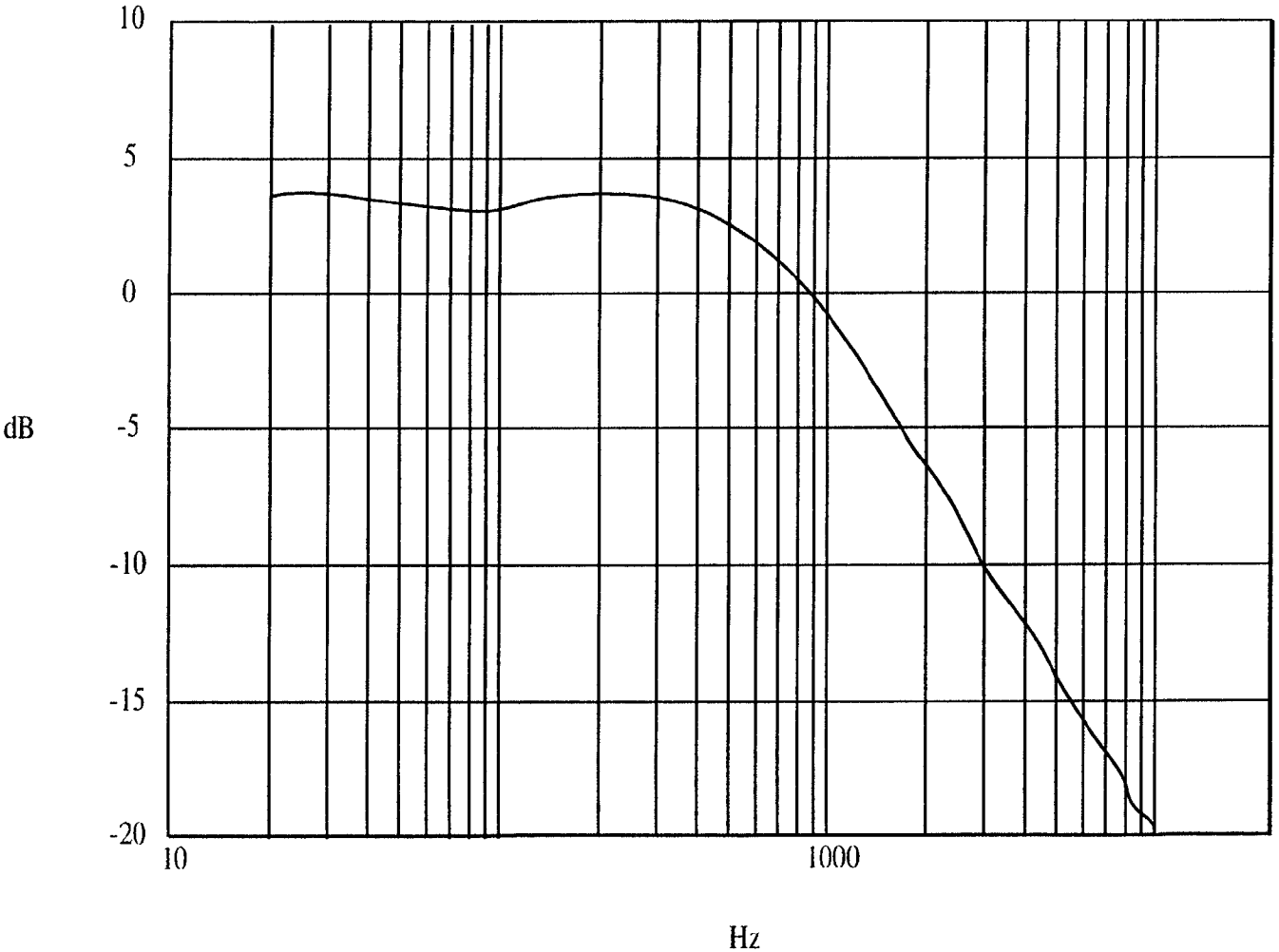

FIG. 7*b*, shows the magnitude response for the combining portion of the circuit of FIG. 6. The magnitude response is a substantially consistent +3 dB over the frequency range of interest, with a rolloff over the low-pass filtered portion of the frequency range.

Figure 8A:
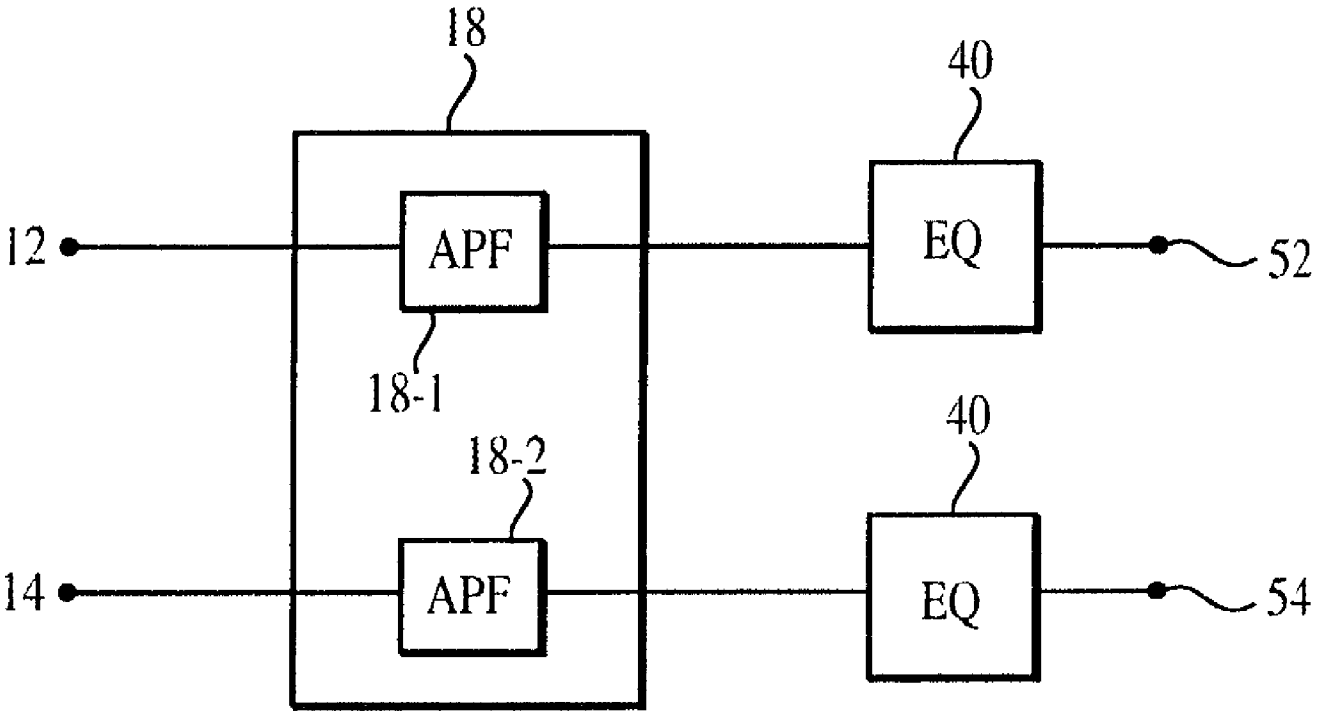
FIG. 8*a* is a block diagram of a circuit according to the invention in which the output signals are all full range signals.

Referring now to FIG. 8*a*, the properties of all-pass filters can be used to simplify the circuits of FIGS. 3*b* and 3*c*, in which the output signals are full range signals. If the phase shifter 18 is implemented as two all-pass filters (18-1 and 18-2), chosen with parameters such that the phase shift operates only on a lower portion of the frequency spectrum, the high frequency paths, the result of FIGS. 3*b* and 3*c*, can be established with the circuit of FIG. 8*a*. With all-pass filter 18-1 having a pole at −378 Hz and a zero at +378 Hz and all-pass filter 18-2 having a pole at −54.7 Hz and a zero at +54.7 Hz, phase shifter 18 shifts the phase by 80 degrees at 63 Hz and by 100 degrees at 315 Hz.

The audio system of FIG. 8*a* is preferably used with a pair of full range speakers. The sound waves radiated in response to the audio signals in the two channels are summed acoustically, after transduction, rather than electronically before transduction as in the embodiment of FIG. 6. In a situation in which radiated sound waves are summed acoustically, the power response is a function of loudspeaker spacing, speaker directivity and the wavelength of the radiated sound, but not the phase response of the audio system. So while equalizers 40 may be desirable for other reasons, in a system such as FIG. 8*a*, the equalizers may be omitted for a spatially averaged target response.

Figure 8B:
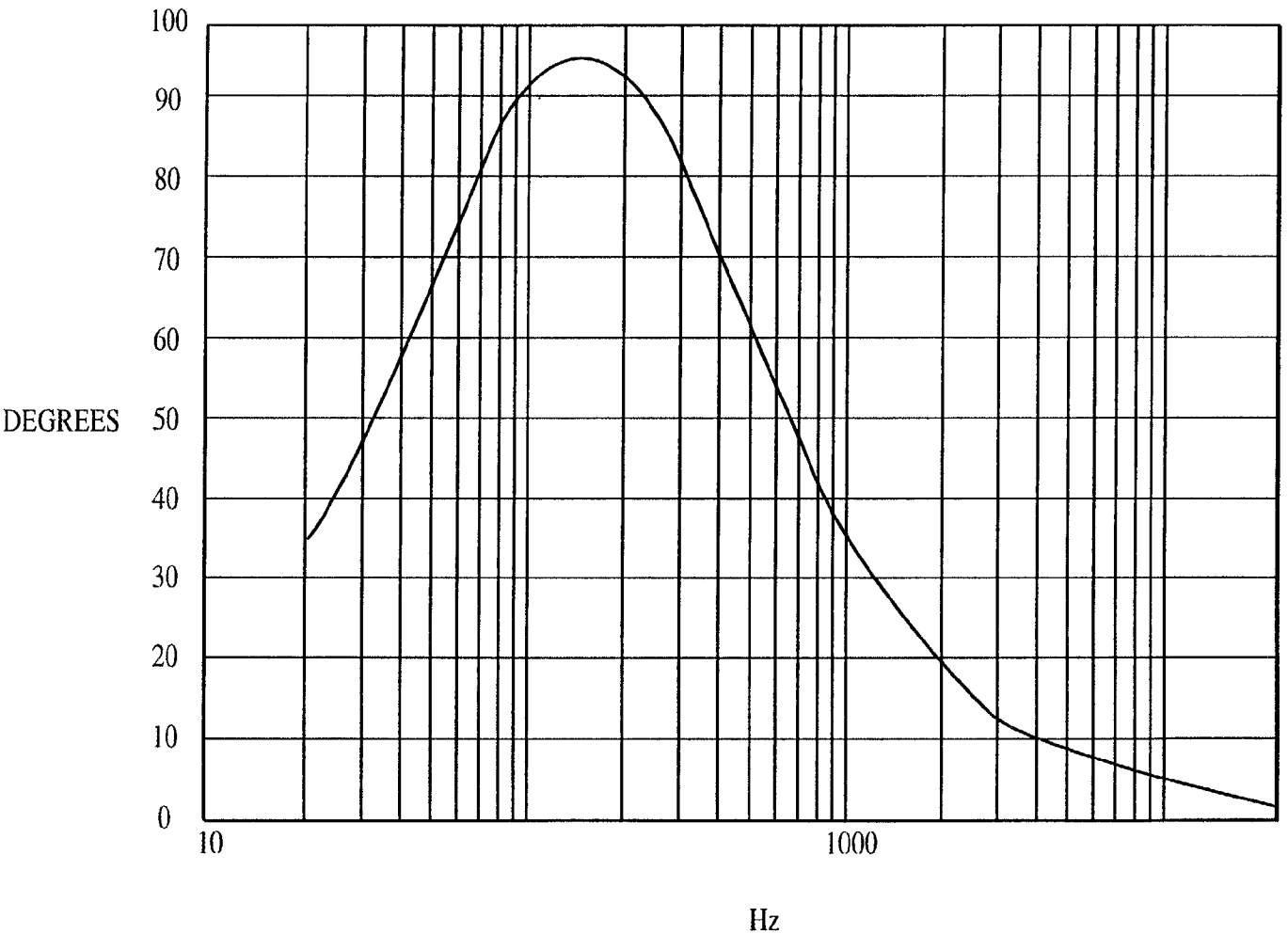
FIG. 8*b* is a plot of phase difference versus frequency for the circuit of FIG. 8*a*.

FIG. 8*b* shows the frequency response of the circuit of FIG. 8*a*.

Figure 9:
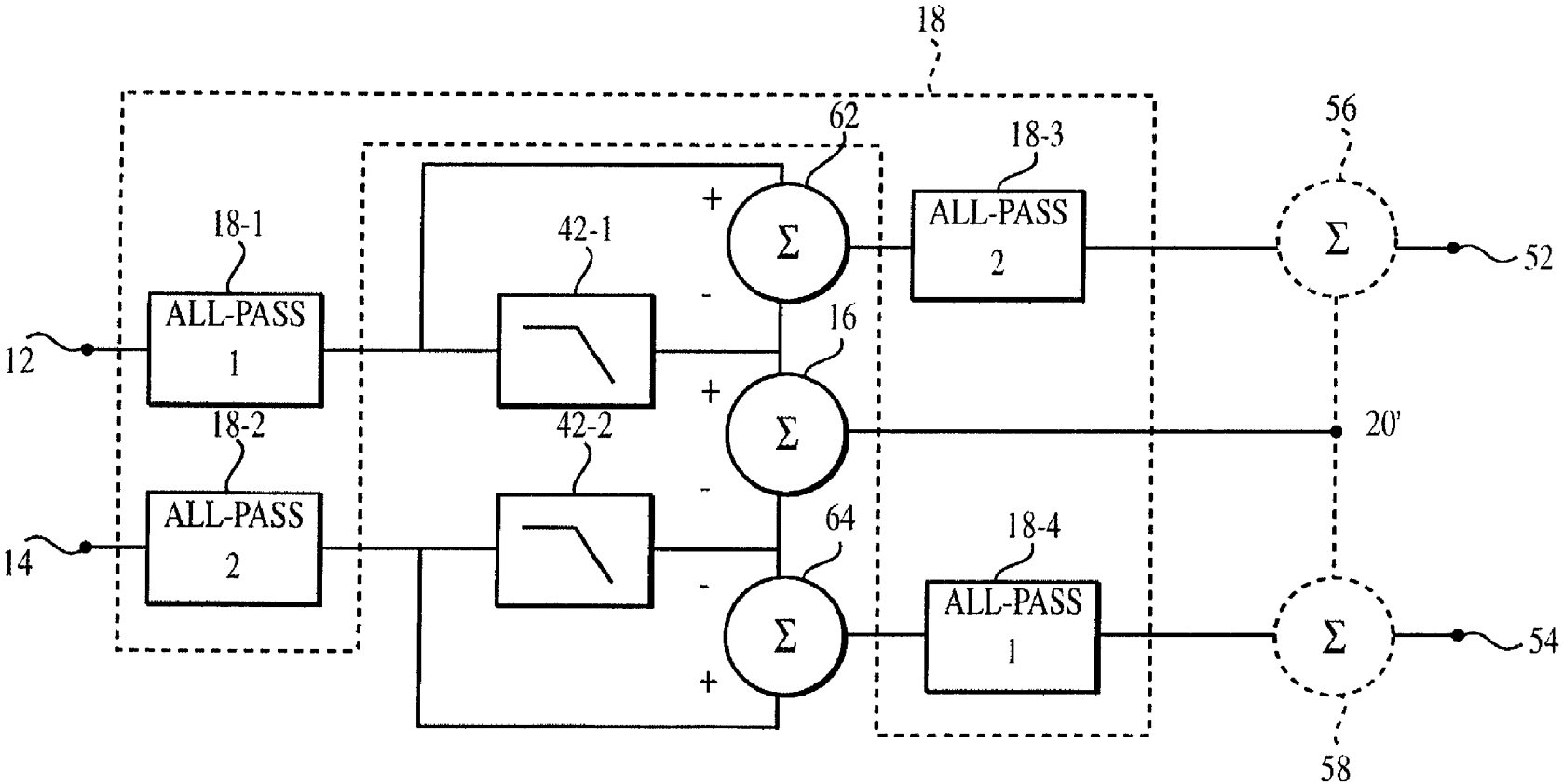
FIG. 9 is a block diagram of another implementation of the invention.

Referring now to FIG. 9, there is shown another implementation of the invention. In the implementation of FIG. 9, circuit input terminals 12 and 14 are coupled to all-pass filters 42-1 and 42-2, respectively, by all-pass filters 18-1 and 18-2, respectively. Output terminals of all-pass filters 42-1 and 42-2, respectively are differentially coupled to input terminals of summers 62 and 64. Output terminal of low-pass filter 42-1 is connected to input terminal of summer 16, and output terminal of low-pass filter 42-2 is differentially coupled to the input terminals of summer 16. Output terminals of all-pass filters 18-1 and 18-2 are connected to input terminals of summers 62 and 64, respectively. Output terminals of summers 62 and 64 are coupled to circuit output terminals 52 and 54 by all-pass filters 18-3 and 18-4, respectively.

In operation, the parameters of all-pass filters 18-1 and 18-2 are selected so that the audio signals input at circuit input terminals 12 and 14 are shifted by different amounts, so that the relative phase shift is in the range of 90 degrees. The phase shifted, low-passed outputs of low-pass filters 42-1 and 42-2 are differentially combined with the non-low-pass filtered signals at summers 62 and 64 so that the outputs of summers 62 and 64 contain only the spectral portion of the audio signal not included in the pass band of low-pass filters 42-1 and 42-2. The outputs of low-pass filters 42-1 and 42-2 are combined at summer 16, so that the signal at the output terminal of summer 16 contains the spectral portion (typically the bass frequencies) of the audio signal included in the pass band of low-pass filters 42-1 and 42-2. Since the signals are combined differentially and since their phase difference is 90 degrees from the initial phase relationship, the signals combine properly, regardless of whatever coding technique that was used to code the signals input at circuit input terminals 12 and 14. The output signals of summers 62 and 64 are processed by all-pass filters 18-3 and 18-4, respectively. All-pass filter 18-3 has the same characteristics as all-pass filter 18-2, and all-pass filter 18-4 has the same characteristics as all-pass filter 18-1. The result is that the phase difference that resulted from the processing by all-pass filters 18-1 and 18-2 is effectively "undone" by the processing by all-pass filters 18-3 and 18-4, and the signals that are output at circuit output terminals 52 and 54 have the same phase relationship as the signals that were input at circuit input terminals 12 and 14. The output signal of summer 16 (typically the bass frequencies) may either be output directly at circuit output terminal 20' as in the implementations of FIGS. 3*a* and 3*d* or may be combined at optional summers 56 and 58 (shown in dashed lines) with the output signals from all-pass filters 18-3 and 18-4 and output at circuit output terminals 52 and 54 as in the implementations of 3*b* and 3*c*.

It is evident that those skilled in the art may now make numerous uses of and departures from the specific apparatus and techniques disclosed herein without departing from the inventive concepts. Consequently, the invention is to be construed as embracing each and every novel feature and novel combination of features present in or possessed by the apparatus and techniques disclosed herein and limited solely by the spirit and scope of the appended claims.

What is claimed is:

1. A method for combining a first audio signal from a first audio channel and a second audio signal from a second audio channel, said first and second audio signals having a first and second frequency range, comprising:

shifting the phase of said first audio signal relative to said second audio signal, wherein said shifting is constant and substantially limited to said first frequency range from about 20 Hz to about 500 Hz; and combining the relatively phase-shifted audio signal from said first channel with the audio signal from said second channel to provide a combined bass frequency signal with the range of phase shifting being between about 60 degrees and about 120 degrees, and electroacoustically transducing the combined bass signal.

2. A method for combining audio signals in accordance with claim 1, wherein said first frequency range is the bass frequency range.

3. A method for combining audio signals in accordance with claim 2, further comprising downmixing a third channel and a fourth channel to produce a one of said first channel or said second channel.

4. A method for combining audio signals in accordance with claim 3, further comprising the step of downmixing a fifth channel and a sixth channel to produce the other of said first channel or said second channel.

5. A method for combining audio signals in accordance with claim 1, further comprising downmixing a third channel and a fourth channel to produce a one of said first channel or said second channel.

6. A method for combining audio signals in accordance with claim 5, further comprising the step of downmixing a fifth channel and a sixth channel to produce the other of said first channel or said second channel.

7. A method for combining audio signals in accordance with claim 1, wherein said relative shifting involves applying said first audio signal to a circuit including a first all-pass filter, filtering said audio signal from said first audio channel, and applying said second audio signal to a circuit including a second all-pass filter, filtering said second audio signal from said second audio channel, wherein parameters of said first all-pass filter and parameters of said second all-pass filter are selected so that said relative shifting occurs only over said first frequency range.

8. A method for combining audio signals in accordance with claim 1, further comprising adjusting the frequency response of the path carrying the combined audio signals.

9. A method for combining audio signals in accordance with claim 8 wherein said adjusting includes equalizing said combined audio signal.

10. A method for combining audio signals in accordance with claim 1, wherein said combining combines only the spectral components in said first frequency range.

11. An audio system comprising:

an audio signal source constructed and arranged to provide a first channel signal and a second channel signal;

a phase shifter, coupled to said audio signal source for shifting by a constant phase angle the phase of said first channel signal relative to said second channel signal, wherein said phase shifter is constructed and arranged to substantially limit said phase shifting to said first range of frequencies, only over a first range of frequencies between about 20 Hz to about 500 Hz with the range of phase shifting between 60 degrees to about 120 degrees a combiner constructed and arranged to combine the relatively phase-shifted first channel signal and second channel signal to provide a combined bass signal, and electroacoustical transducing apparatus constructed and arranged to transduce the combined bass signal .

12. An audio system in accordance with claim 11, is constructed and arranged to maintain the phase of said first channel signal relative to said second channel signal unchanged over a second range of frequencies.

13. An audio system in accordance with claim 12, wherein said first range of frequencies is lower than said second range of frequencies.

14. An audio system, comprising:

a first audio channel input for providing a first audio signal;

a second audio channel input for providing a second audio signal;

phase shifting circuitry, coupled to said first audio channel input and said second audio channel input, for shifting the phase of said first audio signal relative to said second audio signal by a constant phase angle over a first range of frequencies to produce a partially phase shifted audio signal between about 20 Hz to about 500 Hz with the range of phase shifting between about 60 degrees to about 120 degrees, and a combiner, for combining said partially phase shifted first audio signal and said second audio signal to produce a combined bass audio signal, and electroacoustical transducing apparatus constructed and arranged to transduce the combined bass audio signal into radiated bass acoustic signal.

15. An audio system in accordance with claim 14, said phase shifting circuitry includes a first all-pass filter coupling said first audio channel input and said combiner, said first all pass filter having first filter parameters, and a second all pass filter coupling said second audio channel input and said combiner, said second all pass filter having second filter parameters.

16. An audio system in accordance with claim 15, wherein said first filter parameters and said second filter parameters are predetermined so that said phase shifting circuitry shifts the phase of said first audio signal relative to said second audio signal only over said first range of frequencies.

17. An audio system in accordance with claim 16, wherein said first range of frequencies is limited to the bass frequency band.

18. An audio system in accordance with claim 15, further comprising a third all-pass filter coupling said first all-pass filter and said combiner, said third all-pass filter having third filter parameters and a fourth all-pass filter coupling said second all-pass filter and said combiner, said fourth all-pass filter having fourth filter parameters, wherein said first and third all-pass filters have a frequency spacing of approximately 16 and wherein said second and fourth all-pass filters have a spacing of approximately 16.

19. An audio system in accordance with claim 15, further comprising a third all-pass filter coupling said first all pass filter and said combiner, said third all-pass filter having third filter parameters, and a fourth all-pass filter coupling said first all-pass filter and said combiner, said fourth all-pass filter having fourth filter parameters, wherein the combination of said first and third all-pass filters have a frequency spacing factor relative to the combination of said second and fourth all-pass filters of between three and five.

20. An audio system in accordance with claim 14, further comprising a first low-pass filter for filtering said first audio signal and a second low-pass filter for filtering said second audio signal so that said combiner combines only the bass portions of said first audio signal and said second audio signal.

21. An audio system in accordance with claim 14, further comprising a low-pass filter for filtering the output signal of said combiner to provide only the bass portion of said combined signal.

22. An audio system in accordance with claim 14, further comprising a downmixing circuit for downmixing signals in a third channel and a fourth channel to form said first audio signal.

23. An audio system in accordance with claim 14, wherein said combiner combines said partially phase-shifted first audio signal and said second audio signal only in said first range of frequencies.

* * * * *